US007921655B2

(12) United States Patent
Wyatt et al.

(10) Patent No.: US 7,921,655 B2
(45) Date of Patent: Apr. 12, 2011

(54) TOPPING CYCLE FOR A SUB-AMBIENT COOLING SYSTEM

(75) Inventors: William G. Wyatt, Plano, TX (US); James F. Kviatkofsky, Allen, TX (US); James A. Pruett, Lucas, TX (US); Timothy E. Adams, Allen, TX (US); Christopher Moshenrose, Allen, TX (US)

(73) Assignee: Raytheon Company, Waltham, MA (US)

( * ) Notice: Subject to any disclaimer, the term of this patent is extended or adjusted under 35 U.S.C. 154(b) by 255 days.

(21) Appl. No.: 11/859,591

(22) Filed: Sep. 21, 2007

(65) Prior Publication Data

US 2009/0077981 A1 Mar. 26, 2009

(51) Int. Cl.
*F25B 21/02* (2006.01)
*F25B 41/00* (2006.01)
*F25B 49/00* (2006.01)

(52) U.S. Cl. ..... 62/3.2; 62/196.4; 62/332

(58) Field of Classification Search ..... 62/6.2, 62/196.4, 332

See application file for complete search history.

(56) References Cited

U.S. PATENT DOCUMENTS 1,528,619 A 3/1925 Alphonse
1,906,422 A 5/1933 Roulton
2,321,964 A 6/1943 Zieber
2,371,443 A 3/1945 Harold
2,991,978 A 7/1961 Jones
3,131,548 A 5/1964 Chubb et al.
3,174,540 A 3/1965 Dutton (Continued)

FOREIGN PATENT DOCUMENTS

EP 0 243 239 A2 4/1987

(Continued)

OTHER PUBLICATIONS

Kharazi, et al., "Implementation of 3-Port Condensing Wave Rotors in R718 Cycles", Journal of Energy Resources Technology, Dec. 2006, vol. 128, pp. 325-334.

(Continued)

*Primary Examiner* — Thomas E Denion
*Assistant Examiner* — Michael Carton
(74) *Attorney, Agent, or Firm* — Baker Botts L.L.P.

(57) ABSTRACT

According to one embodiment of the disclosure, a cooling system for a heat-generating structure comprises a heat exchanger, a first structure, a condenser heat exchanger, and a second condenser. The heat exchanger is in thermal communication with a heat-generating structure. The heat exchanger has an inlet and an outlet. The inlet is operable to receive fluid coolant substantially in the form of a liquid into the heat exchanger, and the outlet is operable to dispense fluid coolant at least partially in the form of a vapor out of the heat exchanger. The first structure directs a flow of the fluid coolant substantially in the form of a liquid to the heat exchanger. Thermal energy communicated from the heat-generating structure to the fluid coolant causes the fluid coolant substantially in the form of a liquid to boil and vaporize in the heat exchanger. The condenser heat exchanger receives a flow of the fluid coolant at least partially in the form of a vapor from the heat exchanger and transfers at least a portion of the thermal energy within the fluid coolant to a heat sink. The second condenser assists the condenser heat exchanger in transferring at least a portion of the thermal energy within the fluid coolant away from the fluid coolant. The second condenser is selectively activated when the heat sink reaches an undesirable temperature.

25 Claims, 3 Drawing Sheets

| TIME | TEMPERATURE | | R.H. | WIND (AT 3m) | | SOL. RAD. | |
|---|---|---|---|---|---|---|---|
| (LST) | (°C) | (°F) | (%) | (m/s) | (ft/s) | (W/m²) | (Bph) |
| 01 | 35 | 95 | 6 | 3 | 9 | 0 | 0 |
| 02 | 34 | 94 | 7 | 3 | 9 | 0 | 0 |
| 03 | 34 | 93 | 7 | 3 | 9 | 0 | 0 |
| 04 | 33 | 92 | 8 | 3 | 9 | 0 | 0 |
| 05 | 33 | 91 | 8 | 3 | 9 | 0 | 0 |
| 06 | 32 | 90 | 8 | 3 | 9 | 55 | 18 |
| 07 | 33 | 91 | 8 | 3 | 9 | 270 | 85 |
| 08 | 35 | 95 | 6 | 3 | 9 | 505 | 160 |
| 09 | 38 | 101 | 6 | 3 | 9 | 730 | 231 |
| 10 | 41 | 106 | 5 | 4 | 14 | 915 | 291 |
| 11 | 43 | 110 | 4 | 4 | 14 | 1040 | 330 |
| 12 | 44 | 112 | 4 | 4 | 14 | 1120 | 355 |
| 13 | 47 | 116 | 3 | 4 | 14 | 1120 | 355 |
| 14 | 48 | 118 | 3 | 4 | 14 | 1040 | 330 |
| 15 | 48 | 119 | 3 | 4 | 14 | 915 | 291 |
| 16 | 49 | 120 | 3 | 4 | 14 | 730 | 231 |
| 17 | 48 | 119 | 3 | 4 | 14 | 505 | 160 |
| 18 | 48 | 118 | 3 | 4 | 14 | 270 | 85 |
| 19 | 46 | 114 | 3 | 4 | 14 | 55 | 18 |
| 20 | 42 | 108 | 4 | 4 | 14 | 0 | 0 |
| 21 | 41 | 105 | 5 | 4 | 14 | 0 | 0 |
| 22 | 39 | 102 | 6 | 4 | 14 | 0 | 0 |
| 23 | 38 | 100 | 6 | 4 | 14 | 0 | 0 |
| 24 | 37 | 98 | 6 | 3 | 9 | 0 | 0 |

U.S. PATENT DOCUMENTS 3,332,435 A 7/1967 Anderson et al. ..... 137/394
3,334,684 A 8/1967 Roush et al. ..... 165/47
3,371,298 A 2/1968 Narbut
3,524,497 A 8/1970 Chu et al.
3,586,101 A 6/1971 Chu
3,609,991 A 10/1971 Chu et al.
3,731,497 A 5/1973 Ewing ..... 62/160
3,756,903 A 9/1973 Jones
3,774,677 A 11/1973 Antonetti et al.
3,989,102 A 11/1976 Jaster et al.
4,003,213 A 1/1977 Cox
4,019,098 A 4/1977 McCready et al.
4,072,188 A 2/1978 Wilson et al. ..... 165/80
4,129,180 A 12/1978 Larinoff
4,169,356 A 10/1979 Kingham
4,295,341 A 10/1981 Gale
4,296,455 A 10/1981 Leaycraft et al.
4,301,861 A 11/1981 Larinoff
4,330,033 A 5/1982 Okada et al.
4,381,817 A 5/1983 Brigida et al.
4,411,756 A 10/1983 Bennett et al.
4,495,988 A 1/1985 Grossman
4,511,376 A 4/1985 Coury
4,585,054 A 4/1986 Köprunner
4,638,642 A 1/1987 Tokuno
4,691,532 A * 9/1987 Reid et al. ..... 62/476
4,794,984 A 1/1989 Lin
4,843,837 A 7/1989 Ogawa et al. ..... 62/324.1
4,851,856 A 7/1989 Altoz
4,938,280 A 7/1990 Clark
4,945,980 A 8/1990 Umezawa
4,998,181 A 3/1991 Haws et al.
5,021,924 A 6/1991 Kieda et al.
5,067,560 A 11/1991 Carey et al.
5,086,829 A 2/1992 Asakawa
5,128,689 A 7/1992 Wong et al.
5,148,859 A 9/1992 Beamer
5,158,136 A 10/1992 Azar
5,161,610 A 11/1992 Leidinger
5,168,919 A 12/1992 Berenholz et al.
5,181,395 A 1/1993 Carpenter et al.
5,183,104 A 2/1993 Novotny
5,239,443 A 8/1993 Fahey et al.
5,245,839 A 9/1993 Chang et al.
5,261,246 A 11/1993 Blackmon et al.
5,262,587 A 11/1993 Moser ..... 174/15.1
5,283,715 A 2/1994 Carlsten et al. ..... 361/702
5,333,677 A 8/1994 Mclivadas
5,353,865 A 10/1994 Adiutori et al.
5,398,519 A 3/1995 Weber et al. ..... 62/201
5,404,272 A 4/1995 Lebailly et al. ..... 361/700
5,406,807 A 4/1995 Ashiwake et al. ..... 62/376
5,414,592 A 5/1995 Stout et al. ..... 361/704
5,447,189 A 9/1995 McIntyre
5,493,305 A 2/1996 Wooldridge et al.
5,497,631 A 3/1996 Lorentzen et al.
5,501,082 A 3/1996 Tachibana et al.
5,509,468 A 4/1996 Lopez ..... 165/144
5,515,690 A 5/1996 Blackmon et al.
5,522,452 A 6/1996 Mizuno et al.
5,605,054 A 2/1997 Chen
5,655,600 A 8/1997 Dewar et al.
5,666,269 A 9/1997 Romero et al.
5,701,751 A 12/1997 Flores
5,761,037 A 6/1998 Anderson et al.
5,815,370 A 9/1998 Sutton
5,818,692 A 10/1998 Denney, Jr. et al.
5,829,514 A 11/1998 Smith et al.
5,841,564 A 11/1998 McDunn et al.
5,862,675 A 1/1999 Scaringe et al.
5,910,160 A 6/1999 Caakmakci et al.
5,940,270 A 8/1999 Puckett ..... 361/699
5,943,211 A 8/1999 Havey et al.
5,950,717 A 9/1999 Fay
5,960,861 A 10/1999 Price et al.
6,018,192 A 1/2000 Root et al.
6,038,873 A * 3/2000 Koo ..... 62/196.4
6,052,284 A 4/2000 Suga et al.
6,052,285 A 4/2000 Hileman ..... 361/699
6,055,154 A 4/2000 Azar
6,173,758 B1 1/2001 Ward et al.
6,205,803 B1 3/2001 Scaringe ..... 62/259.2
6,292,364 B1 9/2001 Fitzgerald et al.
6,297,775 B1 10/2001 Haws et al.
6,305,463 B1 10/2001 Salmonson
6,347,531 B1 2/2002 Roberts et al.
6,349,760 B1 2/2002 Budelman
6,366,462 B1 4/2002 Chu et al.
6,397,932 B1 6/2002 Calaman et al.
6,415,619 B1 7/2002 Bash et al.
6,498,725 B2 12/2002 Cole et al.
6,519,955 B2 2/2003 Marsala
6,529,377 B1 3/2003 Somadder et al.
6,536,516 B2 3/2003 Davies et al.
6,571,569 B1 6/2003 Rini et al. ..... 62/259.2
6,594,479 B2 7/2003 Ammar et al.
6,603,662 B1 8/2003 Ganrot
6,608,751 B2 8/2003 Ishimine et al. ..... 361/687
6,625,023 B1 9/2003 Morrow et al. ..... 361/700
6,679,081 B2 1/2004 Marsala
6,687,122 B2 2/2004 Monfarad ..... 361/687
6,708,511 B2 3/2004 Martin
6,729,383 B1 5/2004 Cannell et al.
6,796,372 B2 9/2004 Bear ..... 165/104.21
6,827,135 B1 12/2004 Kramer et al.
6,828,675 B2 12/2004 Memory et al. ..... 257/714
6,873,528 B2 3/2005 Hulan et al. ..... 361/719
6,952,345 B2 10/2005 Weber et al.
6,952,346 B2 10/2005 Tilton et al.
6,957,550 B2 10/2005 Wyatt et al.
6,967,841 B1 11/2005 Chu et al. ..... 361/700
6,972,365 B2 12/2005 Garner ..... 174/16.3
6,976,527 B2 12/2005 Kirshberg et al.
6,993,926 B2 2/2006 Rini et al. ..... 62/259.2
7,000,691 B1 2/2006 Weber
7,017,358 B2 3/2006 Wayburn et al. ..... 62/115
7,110,260 B2 9/2006 Weber et al. ..... 361/700
7,133,283 B2 11/2006 Faneuf et al. ..... 361/689
7,193,850 B2 3/2007 Pal ..... 361/700
7,227,753 B2 6/2007 Weber et al. ..... 361/700
7,240,494 B2 * 7/2007 Akei et al. ..... 62/3.2
7,254,957 B2 8/2007 Weber et al.
7,414,843 B2 8/2008 Joshi et al. ..... 361/699
7,508,670 B1 3/2009 Thorson et al. ..... 361/699
7,607,475 B2 10/2009 Weber ..... 165/281
7,626,820 B1 12/2009 Konshak et al. ..... 361/700
2002/0124585 A1 9/2002 Bash et al. ..... 62/228.4
2003/0042003 A1 3/2003 Novotny et al. ..... 165/47
2003/0053298 A1 3/2003 Yamada et al.
2003/0062149 A1 4/2003 Goodson et al.
2003/0188538 A1 10/2003 Chu et al.
2004/0231351 A1 11/2004 Wyatt
2005/0274139 A1 12/2005 Wyatt ..... 62/498
2006/0021736 A1 2/2006 Tran
2007/0119199 A1 5/2007 Weber et al. ..... 62/259.2
2007/0209782 A1 9/2007 Wyatt ..... 165/76
2008/0158817 A1 7/2008 Tsunoda et al. ..... 361/697
2008/0229780 A1 9/2008 Wyatt et al. ..... 62/502
2008/0291629 A1 11/2008 Ali ..... 361/700
2009/0244830 A1 10/2009 Wyatt et al. ..... 361/679.47
2010/0001141 A1 1/2010 Jondeau et al. ..... 244/158.1

FOREIGN PATENT DOCUMENTS

EP 02 51 836 A1 5/1987
EP 0 817 263 A2 10/1991
EP 0 666 214 A1 8/1995
EP 1 054 583 EP 11/2000
EP 1 143 778 A1 10/2001
EP 1 380 799 A 1/2004
EP 1 381 083 A2 1/2004
EP 1 448 040 A 8/2004
EP 1 601 043 A 11/2005
EP 1 610 077 12/2005
EP 1 826 510 8/2007
EP 1 627 192 B1 1/2008
FR 2 730 556 A1 2/1995
GB 1220952 3/1968

| | | |
|---|---|---|
| JP | 4-316972 | 9/1992 |
| WO | WO 00/65890 | 2/2000 |
| WO | WO 02/23966 | 3/2002 |
| WO | WO 2007/102978 | 9/2007 |

OTHER PUBLICATIONS

Karazi, et al. "An Application of Wave Rotor Technology for Performance Enhancement of R718 Refrigeration Cycles", The American Institute of Aeronautics and Astronautics, Inc., pp. 965-977.
Kharazi, et al., "Performance Benefits of R718 Turbo-Compression Cycle Using 3-Port Condensing Wave Rotors", Proceedings of IMECE04; 2004 ASME International Mechanical Engineering Congress and Exposition, Nov. 13-20, 2004, pp. 167-176.
Kharazi, et al., "Preliminary Study of a Novel R718 Turbo-Compression Cycle Using a 3-Port Condensing Wave Rotor", Proceedings of ASME Turbo Expo. 2004, Jun. 14-17, 2004.
Kharazi, et al., "Preliminary Study of a Novel R718 Compression Refrigeration Cycle Using a Three-Port Condensing Wave Rotor", Journal of Engineering for Gas Turbines and Power, Jul. 2005, vol. 127, pp. 539-544.
Akbari, et al., "A Review of Wave Rotor Technology and Its Applications", Proceedings of IMEC04, 2004 ASME International Mechanical Engineering Congress and Exposition, Nov. 13-20, 2004, IMECE2004-60082, pp. 81-103.
Kilicarslan, et al., "A comparative study of water as a refrigerant with some current refrigerants", International Journal of Energy Research, pp. 948-959, 2005.
Akbari, et al., "Utilizing Wave Rotor Technology to Enhance the Turbo Compression in Power and Refrigeration Cycles", Proceedings of IMECE'03, 2003 ASME International Mechanical Engineering, Nov. 16-21, 2003.
European Patent Office Communication, dated Mar. 20, 2008, Reference JL36895P.EPP, 6 pages.
European Search Report for International Application No. PCT/US2007/008842; 9 pages, Oct. 5, 2007.
Margaret Ingels, (pp. 59 and 80 of Willis Haviland Carrier "*Father of Air Conditioning*", Country Life Press—Garden City (1952).
Dirk Van Orshoven, "*The use of water as a refrigerant—an exploratory investigation*", Thesis University Wisconsin, 1991, pp. I, III-XIII, 1-114.
"An Integrated Thermal Architecture for Thermal Management of High Power Electronics", High Power Electronics, http:www.coolingzone.com/Guest/News/NL_JAN_2003/Thermacore/ Thermacore Jan 2003, 22 pages.
Beaty, et al., "New Guidelines for Data Center Cooling", Dec. 2003; 8 pages.
Wilson, et al., "A Thermal Bus System for Cooling Electronic Components in High-Density Cabinets", 2004 AHSRAE Transactions; Symposia, pp. 567-573.
Center for the Analysis and Dissemination of Demonstrated Energy Technology (CADDET), Cooling plant at LEGO uses water as refrigerant, Sep. 1997.
Muller, Norbert, Ph.D. Turbo Chillers using Water as a Refrigerant, Michigan State University, AMSE Process Industry Division PID Newsletter, Fall 2002, p. 3.
Maab, Jurgen and Feddeck, Paul, BINE Projectinfo, BINE Informationsdienst, Wasser als Kaltemittel, Aug. 2003.
Kharzi, A., Ph.D., Preliminary Study of a Novel R718 Turbo-Compression Cycle using a 3-port condensing wave rotor, 2004 International ASME Turbo Exposition, ASME Paper GT2004-53622, Austria, Jun. 2004.
"Subcooled Flow Boiling With Flow Pattern Control" IBM Technical Disclosure Bulletin, vol. 22, Issue 5, pp. 1843-1844 Oct. 1, 1979.
U.S. Appl. No. 10/193,571, filed Jul. 11, 2002, entitled "Method and Apparatus for Removing Heat from a Circuit", 33 pages of text and 3 pages of drawings.
U.S. Appl. No. 10/192,891 filed Jul. 11, 2002 by inventor Richard M. Weber for "Method and Apparatus for Cooling with Coolant at a Subambient Pressure", 21 pages of text and 2 pages of drawings.
U.S. Appl. No. 10/440,716 filed May 19, 2003 by inventors William Gerald Wyatt and Richard M. Weber for "Method and Apparatus for Extracting Non-Condensable Gases in a Cooling System", 21 pages of text and 1 drawing sheet.
U.S. Appl. No. 10/853,038 filed May 25, 2004 by inventors Richard M. Weber, et al. for "Method and Apparatus for Controlling Cooling with Coolant at a Subambient Pressure" 25 pages of text and 4 drawing sheets.
U.S. Appl. No. 11/058,691, filed Feb. 15, 2005 by inventors Weber, et al., "Method and Apparatus for Cooling with Coolant at a Subambient Pressure", 28 pages.
PCT Notification of Transmittal of the International Search Report or the Declaration dated Sep. 27, 2004 for PCT/US2004/015086.
EPO Search Report dated Oct. 25, 2004 for Patent No. 03254283.9-2203; Reference No. JL3846.
EPO Search Report dated Nov. 3, 2004 for Patent No. 03254285.4-2301; Reference No. JL3847.
EP Search Report dated May 4, 2005 for European Patent Application No. EP 04256509.3.
EP Search Report dated Mar. 4, 2005 for European Patent Application No. EP 04256509.3-2220.
Notification of Transmittal of the International Search Report and the Written Opinion of the International Searching Authority or the Declaration Int'l Application No. PCT/US2005/1020544; date of mailing: Oct. 10, 2005; Int'l filed Jun. 10, 2005; 3 pages.
"International Search Report", Int'l Application No. PCT/US2005/020544; Earliest Priority Date: Jun. 14, 2004; Int'l filed: Jun. 10, 2005; 5 pages.
"Written Opinion of the International Searching Authority," Int'l Application No. PCT/US2005/020544; Earliest Priority Date: Jun. 14, 2004; Int'l filing date: Jun. 10, 2005; International Patent Classification: F25B43/04; 9 pages.
Notification of Transmittal of The International Search Report and The Written Opinion of the International Searching Authority, or the Declaration; PCT/US2007/004146; dated Jul. 31, 2007; 6 pages.
Application Bulletin#16; "Water Purity Requirements in Liquid Cooling Systems;" Jun. 12, 1995; 4 pages.
PCT Notification of Transmittal of the International Search Report and the Written Opinion of the International Searching Authority, or the Declaration dated Jan. 14, 2000, Reference, PCT/US2008/076357, 12 pages.
*USPTO; Notice of Allowance and Fee(s) Due* for U.S. Appl. No. 10/192,891 filed Jul. 11, 2002, in the name of Richard M. Weber; (6 pgs.), Date Mailed Sep. 12, 2005.
*USPTO; Office Action* for U.S. Appl. No. 10/192,891 filed Jul. 11, 2002, in the name of Richard M. Weber; (6 pgs.), Date Mailed Jan. 12, 2005.
*USPTO; Office Action* for U.S. Appl. No. 10/192,891 filed Jul. 11, 2002, in the name of Richard M. Weber; (5 pgs.), Date Mailed Mar. 4, 2004.
*USPTO; Office Action* for U.S. Appl. No. 10/192,891 filed Jul. 11, 2002, in the name of Richard M. Weber; (4 pgs.), Date Mailed Sep. 30, 2003.
*USPTO; Notice of Allowance and Fee(s) Due* for U.S. Appl. No. 10/440,716 filed May 19, 2003, in the name of William Gerald Wyatt; (6 pgs.), Date Mailed Jun. 1, 2005.
*USPTO; Final Office Action* for U.S. Appl. No. 10/440,716 filed May 19, 2003, in the name of William Gerald Wyatt; (6 pgs.), Date Mailed Mar. 3, 2005.
*USPTO; Office Action* for U.S. Appl. No. 10/440,716 filed May 19, 2003, in the name of William Gerald Wyatt; (5 pgs.), Date Mailed Oct. 22, 2004.
*USPTO; Office Action* for U.S. Appl. No. 10/440,716 filed May 19, 2003, in the name of William Gerald Wyatt; (9 pgs.), Date Mailed Jun. 10, 2004.
*USPTO; Office Action*, U.S. Appl. No. 10/698,953, filed Oct. 31, 2003, in the name of Richard M. Weber; (5 pgs), Date Mailed Dec. 23, 2004.
*USPTO; Notice of Allowance and Fees Due*, U.S. Appl. No. 10/698,953, filed Oct. 31, 2003, in the name of Richard M. Weber; (7 pgs), Date Mailed Mar. 3, 2005.
*USPTO; Office Action*, for U.S. Appl. No. 10/867,331 filed Jun. 14, 2004, in the name of William G. Wyatt, (10 pgs.), Notification Date Jan. 19, 2010.
*USPTO; Final Office Action*, for U.S. Appl. No. 10/867,331, in the name of William G. Wyatt, (11 pgs.), Notification Date May 17, 2010.

*USPTO; Non-Final Office Action*, U.S. Appl. No. 10/853,038, in the name of Richard M. Weber, (17 pgs), Notification Date Jul. 7, 2006.
*USPTO; Final Office Action*, U.S. Appl. No. 10/853,038, in the name of Richard M. Weber, (10 pgs), Notification Date Dec. 21, 2006.
*USPTO; Adv. Action*, U.S. Appl. No. 10/853,038, in the name of Richard M. Weber, (3 pgs), Notification Date Mar. 5, 2007.
*USPTO; Final Office Action*, U.S. Appl. No. 10/853,038, in the name of Richard M. Weber, (14 pgs), Notification Date Jun. 21, 2007.
*USPTO; Notice of Allowance and Fee(s) Due* for U.S. Appl. No. 11/058,691 filed Feb. 15, 2005, in the name of Richard Martin Weber; (5 pgs.), Date Mailed Apr. 9, 2007.
*USPTO; Office Action* for U.S. Appl. No. 11/058,691 filed Feb. 15, 2005, in the name of Richard Martin Weber; (5 pgs.), Notification Date Jan. 2, 2007.
*USPTO; Office Action* for U.S. Appl. No. 11/154,107 filed Jun. 15, 2005, in the name of Richard M. Weber; (6 pgs.), Date mailed Dec. 23, 2005.
*USPTO; Notice of Allowance and Fee(s) Due* for U.S. Appl. No. 11/154,107 filed Jun. 15, 2005, in the name of Richard M. Weber; (5 pgs.), Date Mailed May 17, 2006.
*USPTO; Office Action* for U.S. Appl. No. 11/371,681 filed Mar. 8, 2006, in the name of William G. Wyatt; (9 pgs.), Notification Date Dec. 10, 2009.
*USPTO; Office Action* for U.S. Appl. No. 11/371,681 filed Mar. 8, 2006, in the name of William G. Wyatt; (8 pgs.), Notification Date Aug. 5, 2009.
*USPTO; Office Action* for U.S. Appl. No. 11/371,681 filed Mar. 8, 2006, in the name of William G. Wyatt; (7 pgs.), Notification Date Jun. 8, 2010.
*USPTO; Advisory Action*, U.S. Appl. No. 11/371,681, filed Mar. 8, 2006, William G. Wyatt, (3 pg), Notification Date Aug. 23, 2010.
*USPTO; Office Action*, U.S. Appl. No. 11/291,041, in the name of Richard M. Weber, (12 pg), Date mailed Jul. 8, 2008.
*USPTO; Final Office Action*, U.S. Appl. No. 11/291,041, in the name of Richard M. Weber, (12 pg), Date mailed Jan. 29, 2009.
*USPTO; Office Action*, U.S. Appl. No. 11/339,241, filed Jan. 24, 2006, in the name of Richard M. Weber, (10 pgs), Notification Date Oct. 9, 2007.
*USPTO; Notice of Allowance and Fees Due*, U.S. Appl. No. 11/339,241, filed Jan. 24, 2006, in the name of Richard M. Weber, (7 pgs), Notification Date Jun. 15, 2009.
*USPTO; Office Action*, U.S. Appl. No. 11/339,241, filed Jan. 24, 2006, in the name of Richard M. Weber, (4 pg), Date mailed Aug. 6, 2007.
*USPTO; Notice of Allowance and Fee(s) Due* for U.S. Appl. No. 11/533,219 filed Sep. 19, 2006, in the name of Richard M. Weber; (8 pgs.), Date Mailed Jan. 31, 2007.
*USPTO; Office Action*, U.S. Appl. No. 12/406,645, filed Mar. 18, 2009, in the name of William G. Wyatt, (9 pgs), Notification Date Feb. 23, 2010.
*USPTO; Notice of Allowance and Fees Due*, U.S. Appl. No. 12/406,645, filed Mar. 18, 2009, in the name of William G. Wyatt, (7 pgs), Notification Date Jul. 1, 2010.
PCT Notification of Transmittal of the International Search Report & Written Opinion of Int'l Searching Authority, or the Declaration , PCT/US 2009/037912; dated Jun. 22, 2009.
*European Patent Office; Communication Pursuant to Article 94(3) EPC* for Application No. 07 755 1992.1201; Ref. JL 53728P EPP, dated Jun. 10, 2010 (4 pgs).
"Heating, Ventilating, and air-Conditioning Applications", 1999 Ashrae Handbook, Atlanta, SI Edition, Chapter 47—Water Treatment, http://www.ashrae.org, pp. 47.1-47.11 (12 pgs), 1999.

* cited by examiner

| TIME | TEMPERATURE | | R.H. | WIND (AT 3m) | | SOL. RAD. | |
|---|---|---|---|---|---|---|---|
| (LST) | (°C) | (°F) | (%) | (m/s) | (ft/s) | ($W/m^2$) | (Bph) |
| 01 | 35 | 95 | 6 | 3 | 9 | 0 | 0 |
| 02 | 34 | 94 | 7 | 3 | 9 | 0 | 0 |
| 03 | 34 | 93 | 7 | 3 | 9 | 0 | 0 |
| 04 | 33 | 92 | 8 | 3 | 9 | 0 | 0 |
| 05 | 33 | 91 | 8 | 3 | 9 | 0 | 0 |
| 06 | 32 | 90 | 8 | 3 | 9 | 55 | 18 |
| 07 | 33 | 91 | 8 | 3 | 9 | 270 | 85 |
| 08 | 35 | 95 | 6 | 3 | 9 | 505 | 160 |
| 09 | 38 | 101 | 6 | 3 | 9 | 730 | 231 |
| 10 | 41 | 106 | 5 | 4 | 14 | 915 | 291 |
| 11 | 43 | 110 | 4 | 4 | 14 | 1040 | 330 |
| 12 | 44 | 112 | 4 | 4 | 14 | 1120 | 355 |
| 13 | 47 | 116 | 3 | 4 | 14 | 1120 | 355 |
| 14 | 48 | 118 | 3 | 4 | 14 | 1040 | 330 |
| 15 | 48 | 119 | 3 | 4 | 14 | 915 | 291 |
| 16 | 49 | 120 | 3 | 4 | 14 | 730 | 231 |
| 17 | 48 | 119 | 3 | 4 | 14 | 505 | 160 |
| 18 | 48 | 118 | 3 | 4 | 14 | 270 | 85 |
| 19 | 46 | 114 | 3 | 4 | 14 | 55 | 18 |
| 20 | 42 | 108 | 4 | 4 | 14 | 0 | 0 |
| 21 | 41 | 105 | 5 | 4 | 14 | 0 | 0 |
| 22 | 39 | 102 | 6 | 4 | 14 | 0 | 0 |
| 23 | 38 | 100 | 6 | 4 | 14 | 0 | 0 |
| 24 | 37 | 98 | 6 | 3 | 9 | 0 | 0 |

*FIG. 1*

TOPPING CYCLE FOR A SUB-AMBIENT COOLING SYSTEM

TECHNICAL FIELD OF THE DISCLOSURE

This disclosure relates generally to the field of cooling systems and, more particularly, to a topping cycle for a sub-ambient cooling system.

BACKGROUND OF THE DISCLOSURE

A variety of different types of structures can generate heat or thermal energy in operation. To prevent such structures from over heating, a variety of different types of cooling systems may be utilized to dissipate the thermal energy, including air conditioning systems.

SUMMARY OF THE DISCLOSURE

According to one embodiment of the disclosure, a cooling system for a heat-generating structure comprises a heat exchanger, a first structure, a condenser heat exchanger, and a second condenser. The heat exchanger is in thermal communication with a heat-generating structure. The heat exchanger has an inlet and an outlet. The inlet is operable to receive fluid coolant substantially in the form of a liquid into the heat exchanger, and the outlet is operable to dispense fluid coolant at least partially in the form of a vapor out of the heat exchanger. The first structure directs a flow of the fluid coolant substantially in the form of a liquid to the heat exchanger. Thermal energy communicated from the heat-generating structure to the fluid coolant causes the fluid coolant substantially in the form of a liquid to boil and vaporize in the heat exchanger. The condenser heat exchanger receives a flow of the fluid coolant at least partially in the form of a vapor from the heat exchanger and transfers at least a portion of the thermal energy within the fluid coolant to a heat sink. The second condenser assists the condenser heat exchanger in transferring at least a portion of the thermal energy within the fluid coolant away from the fluid coolant. The second condenser is selectively activated when the heat sink reaches an undesirable temperature.

Certain embodiments of the disclosure may provide numerous technical advantages. For example, a technical advantage of one embodiment may include the capability to use a topping cycle in a sub-ambient cooling system. Other technical advantages of other embodiments may include the capability to compensate for circumstances in which a heat sink used in a cooling system reaches undesired levels. Yet other technical advantages of other embodiments may include the capability to allow cooling systems to operate in extremely hot environments and extremely cold environments. Still yet other technical advantages of other embodiments may include the capability to use a thermoelectric cooler (TEC) to selectively remove thermal energy from a sub-ambient cooling system. Still yet other technical advantages of other embodiments may include the capability to use a thermoelectric cooler (TEC) to both selectively remove thermal energy from a sub-ambient cooling system and selectively add thermal energy to the sub-ambient cooling system.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present disclosure and its advantages, reference is now made to the following description, taken in conjunction with the accompanying drawings, in which:

FIG. 1 show Table I of the Jun. 23, 1997 version of MIL-HDBK 310;

DETAILED DESCRIPTION OF THE DISCLOSURE

It should be understood at the outset that although example embodiments of the present disclosure are illustrated below, the present disclosure may be implemented using any number of techniques, whether currently known or in existence. The present disclosure should in no way be limited to the example embodiments, drawings, and techniques illustrated below, including the embodiments and implementation illustrated and described herein. Additionally, the drawings are not necessarily drawn to scale.

Sub-ambient cooling systems (SACS) generally include a closed loop of fluid with an evaporator, a condenser, and a pump. The evaporator boils the liquid and feeds the liquid/vapor mixture to the condenser. The condenser removes heat (thermal energy) while condensing the vapor, and feeds the condensed liquid to the pump. The pump then returns the liquid to the evaporator to complete the loop. The evaporator absorbs heat (thermal energy) from a source such as hot electronics and the condenser transfers heat (thermal energy) to a cooling source such as the ambient air.

A SACS may be designed to transfer heat by forced, two-phase boiling from a higher temperature heat source to a lower temperature heat sink. In many cases, ambient temperature of air is a desirable heat sink. Referring to FIG. 1, which is Table I of the Jun. 23, 1997 version of MIL-HDBK 310, the daily cycle of temperature associated with the worldwide hottest 1-percent day (in other words, only 1 percent of the time are temperatures hotter than this) has values that vary between a high value of 49° C. and a low value of 32° C. If we take into consideration that a delta temperature of 15° C. is needed in the evaporator and the condenser, the high value is sometimes too high to cool electronics while the low value is still acceptable.

As can be seen above, difficulties with a cooling system, such as a SACS, can arise when the available heat sink such as the ambient temperature is higher than the desired temperature of the heat source such as the hot electronics. Accordingly, teachings of some embodiments of the disclosure recognize a cooling system that compensates for circumstances when the heat sink (e.g., ambient temperature) reaches an undesirable level. Additionally, teachings of some embodiments of the disclosure recognize a cooling system that provides a second condenser that allows dissipation of thermal energy to a heat sink that has an undesirable desirable level. Additionally, teachings of some embodiments of the disclosure recognize a cooling system that provides a mechanism, which can compensate for both undesirably hot and undesirably cold conditions.

Figure 2:
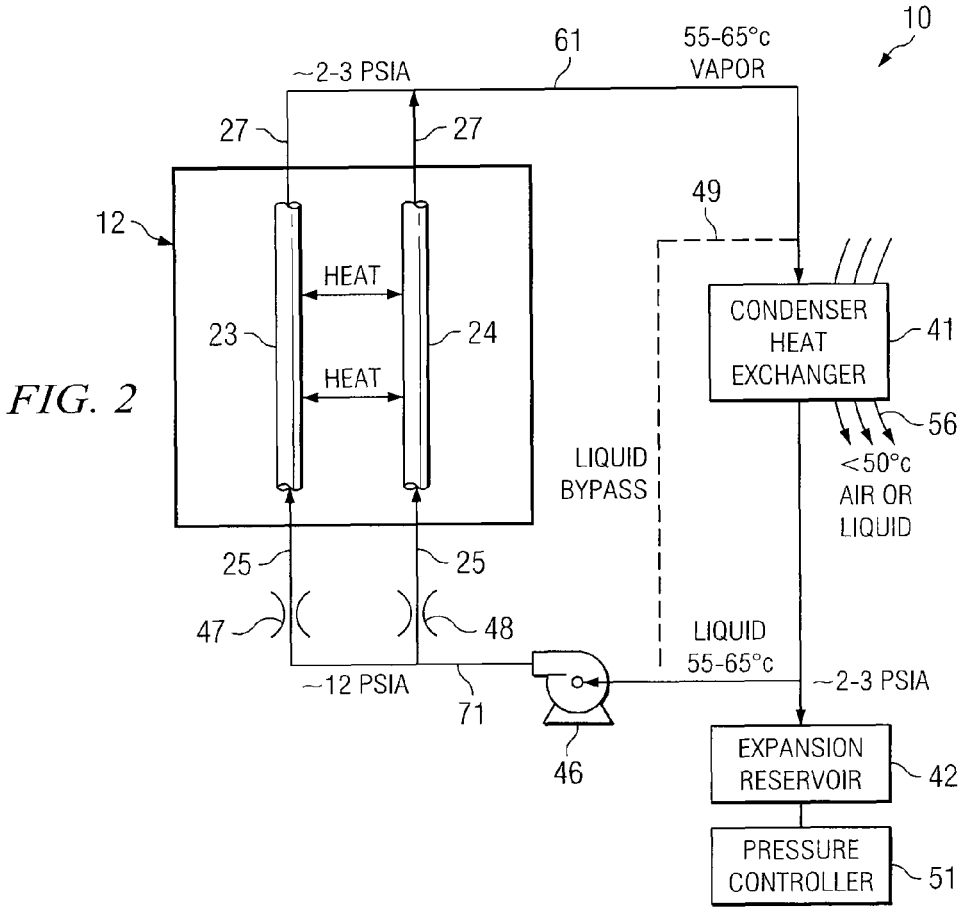
FIG. 2 is a block diagram of an embodiment of a cooling system that may be utilized in conjunction with other embodiments disclosed herein.

FIG. 2 is a block diagram of an embodiment of a cooling system 10 that may be utilized in conjunction with other embodiments disclosed herein, namely the embodiments described with reference to FIGS. 3-5. Although the details of one cooling system will be described below, it should be expressly understood that other cooling systems may be used in conjunction with embodiments of the disclosure.

The cooling system 10 of FIG. 2 is shown cooling a structure 12 that is exposed to or generates thermal energy. The structure 12 may be any of a variety of structures, including, but not limited to, electronic components, circuits, computers, and servers. Because the structure 12 can vary greatly, the details of structure 12 are not illustrated and described. The cooling system 10 of FIG. 2 includes a vapor line 61, a liquid line 71, heat exchangers 23 and 24, a pump 46, inlet orifices 47 and 48, a condenser heat exchanger 41, an expansion reservoir 42, and a pressure controller 51.

The structure 12 may be arranged and designed to conduct heat or thermal energy to the heat exchangers 23, 24. To receive this thermal energy or heat, the heat exchanger 23, 24 may be disposed on an edge of the structure 12 (e.g., as a thermosyphon, heat pipe, or other device) or may extend through portions of the structure 12, for example, through a thermal plane of structure 12. In particular embodiments, the heat exchangers 23, 24 may extend up to the components of the structure 12, directly receiving thermal energy from the components. Although two heat exchangers 23, 24 are shown in the cooling system 10 of FIG. 1, one heat exchanger or more than two heat exchangers may be used to cool the structure 12 in other cooling systems.

In operation, a fluid coolant flows through each of the heat exchangers 23, 24. As discussed later, this fluid coolant may be a two-phase fluid coolant, which enters inlet conduits 25 of heat exchangers 23, 24 in liquid form. Absorption of heat from the structure 12 causes part or all of the liquid coolant to boil and vaporize such that some or all of the fluid coolant leaves the exit conduits 27 of heat exchangers 23, 24 in a vapor phase. To facilitate such absorption or transfer of thermal energy, the heat exchangers 23, 24 may be lined with pin fins or other similar devices which, among other things, increase surface contact between the fluid coolant and walls of the heat exchangers 23, 24. Additionally, in particular embodiments, the fluid coolant may be forced or sprayed into the heat exchangers 23, 24 to ensure fluid contact between the fluid coolant and the walls of the heat exchangers 23, 24.

The fluid coolant departs the exit conduits 27 and flows through the vapor line 61, the condenser heat exchanger 41, the expansion reservoir 42, a pump 46, the liquid line 71, and a respective one of two orifices 47 and 48, in order to again to reach the inlet conduits 25 of the heat exchanger 23, 24. The pump 46 may cause the fluid coolant to circulate around the loop shown in FIG. 2. In particular embodiments, the pump 46 may use magnetic drives so there are no shaft seals that can wear or leak with time. Although the vapor line 61 uses the term "vapor" and the liquid line 71 uses the terms "liquid", each respective line may have fluid in a different phase. For example, the liquid line 71 may have contain some vapor and the vapor line 61 may contain some liquid.

The orifices 47 and 48 in particular embodiments may facilitate proper partitioning of the fluid coolant among the respective heat exchanger 23, 24, and may also help to create a large pressure drop between the output of the pump 46 and the heat exchanger 23, 24 in which the fluid coolant vaporizes. The orifices 47 and 48 may have the same size, or may have different sizes in order to partition the coolant in a proportional manner which facilitates a desired cooling profile.

A flow 56 of fluid (either gas or liquid) may be forced to flow through the condenser heat exchanger 41, for example by a fan (not shown) or other suitable device. In particular embodiments, the flow 56 of fluid may be ambient fluid. The condenser heat exchanger 41 transfers heat from the fluid coolant to the flow 56 of ambient fluid, thereby causing any portion of the fluid coolant which is in the vapor phase to condense back into a liquid phase. In particular embodiments, a liquid bypass 49 may be provided for liquid fluid coolant that either may have exited the heat exchangers 23, 24 or that may have condensed from vapor fluid coolant during travel to the condenser heat exchanger 41. In particular embodiments, the condenser heat exchanger 41 may be a cooling tower.

The liquid fluid coolant exiting the condenser heat exchanger 41 may be supplied to the expansion reservoir 42. Since fluids typically take up more volume in their vapor phase than in their liquid phase, the expansion reservoir 42 may be provided in order to take up the volume of liquid fluid coolant that is displaced when some or all of the coolant in the system changes from its liquid phase to its vapor phase. The amount of the fluid coolant which is in its vapor phase can vary over time, due in part to the fact that the amount of heat or thermal energy being produced by the structure 12 will vary over time, as the structure 12 system operates in various operational modes.

Turning now in more detail to the fluid coolant, one highly efficient technique for removing heat from a surface is to boil and vaporize a liquid which is in contact with a surface. As the liquid vaporizes in this process, it inherently absorbs heat to effectuate such vaporization. The amount of heat that can be absorbed per unit volume of a liquid is commonly known as the latent heat of vaporization of the liquid. The higher the latent heat of vaporization, the larger the amount of heat that can be absorbed per unit volume of liquid being vaporized.

The fluid coolant used in the embodiment of FIG. 2 may include, but is not limited to, mixtures of antifreeze and water or water, alone. In particular embodiments, the antifreeze may be ethylene glycol, propylene glycol, methanol, or other suitable antifreeze. In other embodiments, the mixture may also include fluoroinert. In particular embodiments, the fluid coolant may absorb a substantial amount of heat as it vaporizes, and thus may have a very high latent heat of vaporization.

Water boils at a temperature of approximately 100° C. at an atmospheric pressure of 14.7 pounds per square inch absolute (psia). In particular embodiments, the fluid coolant's boiling temperature may be reduced to between 55-65° C. by subjecting the fluid coolant to a subambient pressure of about 2-3 psia. Thus, in the cooling system 10 of FIG. 2, the orifices 47 and 48 may permit the pressure of the fluid coolant downstream from them to be substantially less than the fluid coolant pressure between the pump 46 and the orifices 47 and 48, which in this embodiment is shown as approximately 12 psia. The pressure controller 51 maintains the coolant at a pressure of approximately 2-3 psia along the portion of the loop which extends from the orifices 47 and 48 to the pump 46, in particular through the heat exchangers 23 and 24, the condenser heat exchanger 41, and the expansion reservoir 42. In particular embodiments, a metal bellows may be used in the expansion reservoir 42, connected to the loop using brazed joints. In particular embodiments, the pressure controller 51 may control loop pressure by using a motor driven linear actuator that is part of the metal bellows of the expansion reservoir 42 or by using small gear pump to evacuate the loop to the desired pressure level. The fluid coolant removed may be stored in the metal bellows whose fluid connects are brazed. In other configurations, the pressure controller 51 may utilize other suitable devices capable of controlling pressure.

In particular embodiments, the fluid coolant flowing from the pump 46 to the orifices 47 and 48 through liquid line 71 may have a temperature of approximately 55° C. to 65° C. and a pressure of approximately 12 psia as referenced above. After passing through the orifices 47 and 48, the fluid coolant may still have a temperature of approximately 55° C. to 65° C., but may also have a lower pressure in the range about 2 psia to 3 psia. Due to this reduced pressure, some or all of the fluid coolant will boil or vaporize as it passes through and absorbs heat from the heat exchanger 23 and 24.

After exiting the exits ports 27 of the heat exchanger 23, 24, the subambient coolant vapor travels through the vapor line 61 to the condenser heat exchanger 41 where heat or thermal energy can be transferred from the subambient fluid coolant to the flow 56 of fluid. The flow 56 of fluid in particular embodiments may have a temperature of less than 50° C. In other embodiments, the flow 56 may have a temperature of less than 40° C. As heat is removed from the fluid coolant, any portion of the fluid which is in its vapor phase will condense such that substantially all of the fluid coolant will be in liquid form when it exits the condenser heat exchanger 41. At this point, the fluid coolant may have a temperature of approximately 55° C. to 65° C. and a subambient pressure of approximately 2 psia to 3 psia. The fluid coolant may then flow to pump 46, which in particular embodiments 46 may increase the pressure of the fluid coolant to a value in the range of approximately 12 psia, as mentioned earlier. Prior to the pump 46, there may be a fluid connection to an expansion reservoir 42 which, when used in conjunction with the pressure controller 51, can control the pressure within the cooling loop.

It will be noted that the embodiment of FIG. 2 may operate without a refrigeration system. In the context of electronic circuitry, such as may be utilized in the structure 12, the absence of a refrigeration system can result in a significant reduction in the size, weight, and power consumption of the structure provided to cool the circuit components of the structure 12.

As alluded to above, teachings of some embodiments of the disclosure recognize a cooling system that compensates for circumstances when the heat sink (e.g., ambient temperature) reaches an undesirable level. The compensation mechanism in certain embodiments described below is sometimes referred to as a "topping cycle." In FIG. 3, the compensation mechanism in the form of a second condenser may cool directly to ambient air while in FIG. 4, the compensation mechanism—also in the form of a secondary condenser—cools to a secondary loop of fluid, which in turn may cool to ambient air.

Figure 3:
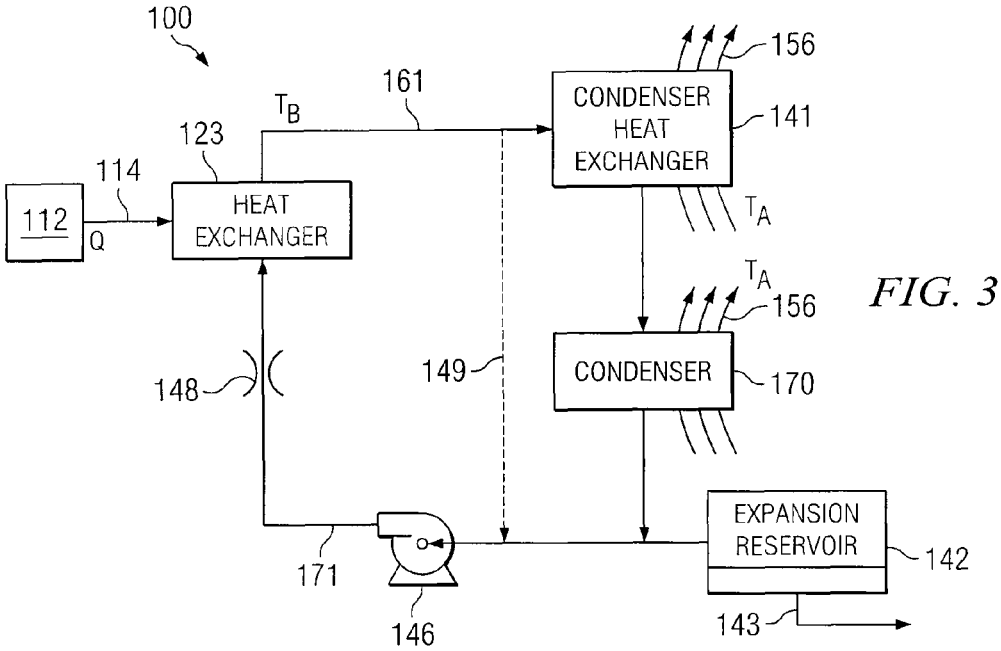
FIG. 3 is a block diagram of a cooling system, according to an embodiment of the disclosure.

FIG. 3 is a block diagram of a cooling system 100, according to an embodiment of the disclosure. The cooling system 100 of FIG. 3 includes components similar to the cooling system 10 of FIG. 1, including a heat exchanger 123 that receives thermal energy (indicated by arrow 114) from a structure 112, a vapor line 161, a condenser heat exchanger 141 that may dispense thermal energy to a flow 156 of fluid (e.g., ambient air), a liquid bypass 149, a pump 146, a liquid line 171, an expansion reservoir 142 that may have a vacuum flow 143, and a control orifice 148.

The cooling system 100 of FIG. 3 also includes additional components, which help compensate when the temperature, $T_A$, associated with the flow 156 of fluid has risen higher than an acceptable maximum. Specifically, in this embodiment, the cooling system 100 of FIG. 3 includes a second condenser 170 that may also dispense thermal energy to the flow 156 of fluid. In this embodiment, the second condenser is a thermoelectric cooler (TEC) designed to transfer thermal energy from one location in the TEC to another location in the TEC using energy such as electrical energy. In the embodiment of the system 100 of FIG. 3, the second condenser 170 transfer thermal energy from the vapor line 161 (generally at a temperature, $T_B$) to the flow of fluid 156 (generally at a temperature, $T_A$). This can occur in the second condenser 170 even if the temperature, $T_A$, is greater than the temperature, $T_B$, because the second condenser 170 uses other energy (e.g., electrical energy) to effectuate this thermal flow.

In general, TECs (also sometimes referred to as a Peltier devices) use electrical energy to transfer thermal energy from one side of the TEC to the other side of the TEC. As an example, in one configuration, a TEC may have a first plate and a second plate with bismuth telluride disposed therebetween. Upon applying a current to the TEC in one direction, the first plate becomes cool while the second plate becomes hot. This is due to the electrical energy causing the thermal energy to be transferred from the first plate to the second plate. Upon applying the current to the same TEC in the opposite direction, the second plate becomes cool while the first plate becomes hot. Thus, TECs can be used to either remove thermal energy from one plate or add thermal energy to same one plate. There are a variety of manufactures of thermoelectric devices, including, but not limited to, Marlow Industries, Inc. of Dallas, Tex. and Melcor of Trenton, N.J.

In the embodiment of FIG. 3, the cooling system 300 may use the TEC in the second condenser 170 to remove thermal energy from the fluid line 161. In doing so, the second condenser 170 dispenses the removed thermal energy directly to the flow 156 of fluid, which may be ambient air.

Thus, in one embodiment, the second condenser 170 allows the temperature of the cooling air, $T_A$, to rise to an unacceptable level as compared to the desired cooling fluid temperature, $T_B$. In operation, the condenser heat exchanger 141 may operate when the air temperature, $T_A$, is less than the desired temperature of the cooling fluid, $T_B$. Then, when the air temperature, $T_A$, becomes greater than the fluid operating temperature, $T_B$, the fan for the condenser heat exchanger 141 may be turned off and the second condenser heat exchanger 170 will maintain the desired temperature level of the fluid by absorbing thermal energy therefrom, for example, using a current applied to TEC.

Although a TEC has been described as being used in the second condenser 170, it should be understood that other devices may be utilized to effectuate the desired thermal flow. Examples include, but are not necessarily limited to a vapor cycle with refrigerant that utilize energy to effectuate the desired thermal flow. Any of a variety of energy sources may be utilized for the TEC and other devices, including, but not limited to, batteries, generated energy, solar energy, and/or combinations of the preceding.

Figure 4:
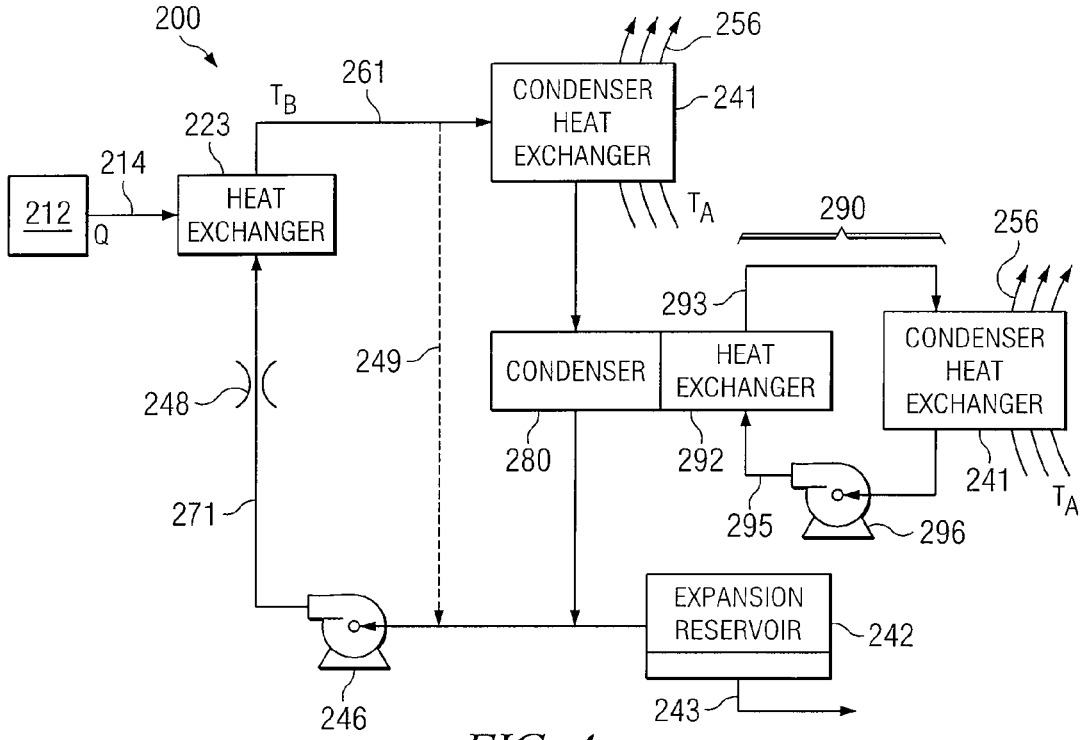
FIG. 4 is a block diagram of another cooling system, according to another embodiment of the disclosure.

FIG. 4 is a block diagram of another cooling system 200, according to another embodiment of the disclosure. The cooling system 200 of FIG. 4 includes components similar to the cooling system 10 of FIG. 2 and the cooling system 100 of FIG. 3, including a heat exchanger 223 that receives thermal energy (indicated by arrow 214) from a structure 212, a vapor line 261, a condenser heat exchanger 241 that may dispense thermal energy to a flow 256 of fluid (e.g., ambient air), a liquid bypass 249, a pump 246, a liquid line 271, an expansion reservoir 242 that may have a vacuum flow 243, and a control orifice 248.

The cooling system 200 of FIG. 4, similar to the cooling system 100 of FIG. 3 also includes additional components, which help compensate when the temperature, $T_A$, associated with the flow 256 of fluid has risen higher than an acceptable maximum. Specifically, in this embodiment, the cooling system 200 of FIG. 4 includes a second condenser 280 that dispenses thermal energy to a fluid loop 290, which may ultimately dissipate the thermal energy to the flow 256 of fluid.

In this embodiment, the second condenser 280 may be a thermoelectric cooler (TEC) designed to transfer thermal energy from one location in the TEC to another location in the TEC using energy such as electrical energy. In the embodiment of the system 200 of FIG. 4, the second condenser 280 transfers thermal energy from the vapor line 261 to a heat exchanger 292 of the loop 290. In particular embodiments, this can occur because the second condenser 270 uses other energy (e.g., electrical energy) to effectuate this thermodynamic flow.

The loop 290 may operate in a similar manner to system 10 of FIG. 2, including a heat exchanger 292, a vapor line 293, a condenser heat exchanger 294, a pump 296, and a fluid line 295. For example, fluid in the heat exchanger 292 can receive thermal energy from the second condenser 280 and transfer the fluid (including the thermal energy) through the vapor line 293 to the condenser heat exchanger for dissipation of the thermal energy to the flow 256 of fluid. The fluid is returned to the pump 296 and to the condenser heat exchanger.

In particular embodiments, the loop 290 may operate as a two-phase loop. In other embodiments, the loop 290 may be a single phase loop. Additionally, the loop 290 may use similar or different fluids to the system 10 of FIG. 2. Additionally, in particular embodiments, the loop 290 may not operate at sub-ambient temperatures. In other embodiments, the loop 290 may operate at subambient temperatures.

In particular embodiments, the use of the system 200 of FIG. 4 with the loop 290 may allow for larger pressure drops than may be accomplished using dissipation directly to air, for example, with reference to the system 100 of FIG. 3. As indicated above, the systems 100, 200 of FIGS. 3 and 4 may generally be referred to as having a "Topping Cycle."

Figure 5:
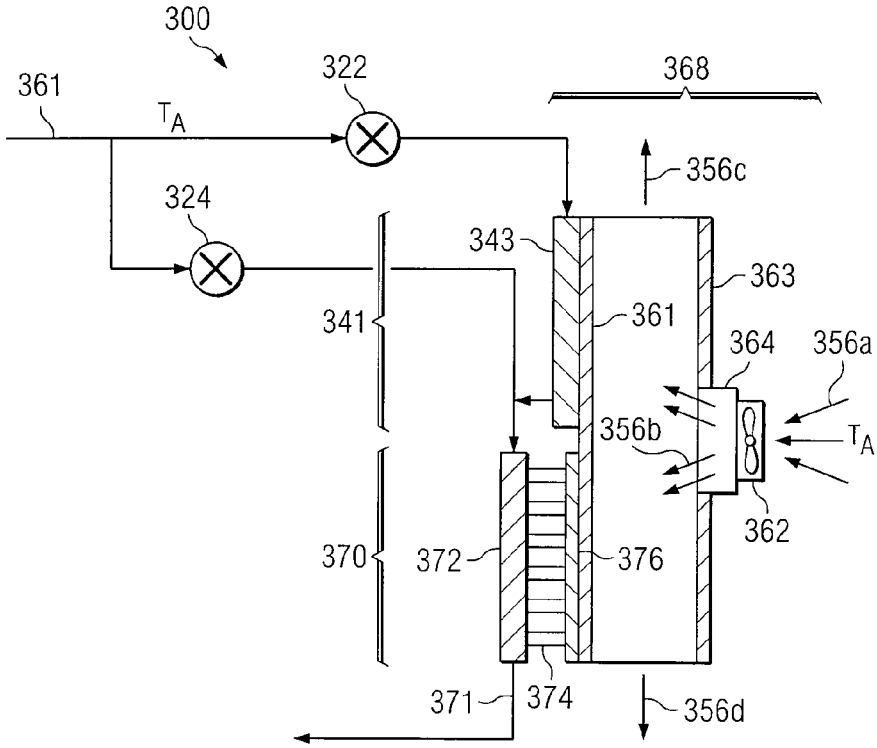
FIG. 5 is a block diagram of a portion of a system, showing an example operation of a secondary condenser in conjunction with a condenser heat exchanger, according to an embodiment of the disclosure.

FIG. 5 is a block diagram of a portion of a system 300, showing an example operation of a secondary condenser 370 in conjunction with a condenser heat exchanger 341, according to an embodiment of the disclosure. The system 300 may operate in a similar manner to the systems 100, 200 of FIGS. 3 and 4, having a vapor line 361 deliver fluid for dissipation of thermal energy (e.g., to be condensed) and a fluid line 371, which receives fluid with the thermal energy dissipated (e.g., condensed).

In the system 300 of FIG. 5, the condenser heat exchanger 341 and the second condenser 370 use a common air dissipation system 368. The air dissipation system 368 includes an inner coldplate wall 361, an outer coldplate wall 363, a plenum 364, and a fan 362. The fan 362 generally brings in a flow 356*a* of fluid (e.g., ambient air) through the plenum 364 to flow (e.g., flow 356*b*) between the inner coldplate wall 361 and the outer coldplate wall 363 and exit out one of two ends of the air dissipation system 368 (e.g., flow 356*c* and 356*d*). The inner coldplate wall 361 and the outer coldplate wall 363 may be made of a variety of materials, including, but not limited to metals such as aluminum.

A coldplate wall 343 of the condenser heat exchanger 341 and a second plate 376 of the second condenser 370 are both in thermal communication with the inner coldplate wall 361. Accordingly, in embodiments in which the inner coldplate wall 361 is aluminum, thermal energy may be transported from either one of the heat exchanger 341 or the second plate 376 for dissipation through the entire inner coldplate wall 361.

In this embodiment, the second condenser 370 is a TEC, which includes a first plate 374 and the second plate 376 which are separated by a structure 374 that may include bismuth telluride. The second condenser 370 may be a single TEC or have a series of TECs located therein. As discussed above, the application of current to the structure 374 (which includes the contents of the structure 374) in one direction may force thermal energy from the first plate 372 towards the second plate 376. Conversely, application of current to the structure 372 in the opposite direction may force thermal energy from the second plate 376 to the first plate 374, for example, for a heating operation that will be described in further details below. Although a TEC has been described as being used in the second condenser 370 in this embodiment, other devices may be used in the second condenser 370, including, but not limited to standard refrigeration cycles.

The system 300 includes two valves 322, 324, which may facilitate an apportioned distribution to the condenser heat exchanger 341 and the second condenser 370. For example, in operation, if the temperature of the air, $T_A$, is suitable for operation of the system 300, the valve 322 may be substantially open and the valve 324 may be substantially closed. As the temperature, $T_A$, approaches an undesirable level, the valve 322 may begin to close and the valve 324 may begin to open. Additionally, current may begin to be applied to the structure 374 to transfer thermal energy from the first plate 372 to the second plate 376. As the air temperature meets or exceeds the undesirable level, the valve 322 may become substantially closed and the valve 324 may begin to become substantially open. Additionally, even more current be applied to the structure 374 to transfer thermal energy from the first plate 372 to the second plate 376. In particular embodiments, the amount of current applied to the structure 374 may be adjusted or modulated, according to a desired need, for example, based not only on the temperature, $T_B$, of the fluid in the fluid line 361, but also on the temperature, $T_A$, of the heat sink, ambient air.

Although not expressly shown, a variety of monitoring systems may be utilized in conjunction with logic that is used to determine the degree of opening of the valves and the amount of current applied to the structure 374. The following illustrates a non-limiting example: valve 322 may be open when the temperature of the air is less than 50° C. and valve 324 may be slightly open when temperature of the air is greater than 40° C. As the temperature traverses this range, valve 322 may begin to close while valve 324 begins to open and the TECs begins to receive a higher current.

Although a general configuration has been illustrated above, it should be understood that a variety of configurations may be utilized in an interoperation between a condenser heat exchanger and a secondary condenser. Additionally, as indicated above, in particular embodiments the secondary condenser may be a standard refrigeration cycle.

As alluded to above, in particular embodiments, current may be applied to the structure 374 in the opposite direction to transfer thermal energy from the second plate 376 towards the first plate 372. In such an embodiment, the TEC would effectively be heating the fluid. Such an operation may be used in embodiments where the ambient temperature, $T_A$, becomes critically low, for example, freezing or close to freezing.

Using the TEC in the second condenser 370 may allow the system 300 to operate in not only extremely cold environments, but also in extremely hot environments. In either of these environments, the TEC allows for compensation for these environmental conditions. For example, when the ambient air becomes too hot, the TEC removes thermal energy from the system to compensate for the undesirable heat sink (the ambient air). Conversely, when the ambient air becomes too cold, the TEC injects thermal energy into the system to compensate for the undesirable cold (freezing up of the fluid in the system).

Using the TEC may also allow reduced amounts of antifreeze being mixed with water in the fluid. In general, a fluid coolant containing only water has a higher heat transfer coefficient than a fluid coolant containing both water and antifreeze. Antifreeze is generally added to lower the freezing point of the coolant. Thus, in particular embodiments, the TEC may allow the a mixture with less antifreeze or water, alone, to remain above the higher freezing temperature by injecting thermal energy into the fluid at a location at the opposite end of the loop of the heat source.

Additionally, Because the TEC in particular embodiments may be utilized to inject thermal energy into the fluid, the TEC in some embodiments may be utilized to facilitate a separation of water from antifreeze in embodiments in which the fluid comprises a mixture of antifreeze and water. In such embodiments, the TEC may be used to vaporize water while leaving the antifreeze behind. Descriptions of such systems in which the dual-use TECs may be incorporated are described with reference to Ser. No. 11/689,947, the entirety of which is hereby incorporated by reference.

With reference to fluids, in addition to the fluids described herein, fluids such as R-134a could be used in both parts of the system (general loop and loop 290 of FIG. 3). While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A cooling system for a heat-generating structure, the cooling system comprising:

a heat exchanger in physical contact and conductive thermal communication with a heat-generating structure, the heat exchanger having an inlet and an outlet, the inlet operable to receive fluid coolant substantially in the form of a liquid into the heat exchanger, and the outlet operable to dispense fluid coolant at least partially in the form of a vapor out of the heat exchanger;

a first structure which directs a flow of the fluid coolant substantially in the form of a liquid to the heat exchanger, thermal energy communicated from the heat-generating structure to the fluid coolant causing the fluid coolant substantially in the form of a liquid to boil and vaporize in the heat exchanger so that the fluid coolant absorbs at least a portion of the thermal energy from the heat-generating structure as the fluid coolant changes state;

a condenser heat exchanger that receives a flow of the fluid coolant at least partially in the form of a vapor from the heat exchanger and transfers at least a portion of the thermal energy within the fluid coolant to a heat sink; and a second condenser that assists the condenser heat exchanger in transferring at least a portion of the thermal energy within the fluid coolant away from the fluid coolant, the second condenser including a thermoelectric cooler (TEC) that removes thermal energy away from the fluid coolant upon application of an electric current to the thermoelectric cooler (TEC), the electric current selectively applied to the thermoelectric cooler (TEC) for removing the thermal energy away from the fluid coolant when the heat sink reaches an undesirable temperature.

2. The cooling system of claim 1, further comprising at least one valve operable to apportion a flow of fluid coolant to the condenser heat exchanger or the second condenser based on a temperature of the heat sink and a temperature of the fluid coolant traveling between the heat exchanger and the condenser heat exchanger.

3. The cooling system of claim 1, wherein the electric current applied to the thermoelectric cooler (TEC) is varied based on a temperature of the heat sink and a temperature of the fluid coolant traveling between the heat exchanger and the condenser heat exchanger.

4. The cooling system of claim 1, wherein the heat sink is ambient air, and at least the heat exchanger operates at a sub-ambient temperature.

5. A cooling system for a heat-generating structure, the cooling system comprising:

a heat exchanger in physical contact and conductive thermal communication with a heat-generating structure, the heat exchanger having an inlet and an outlet, the inlet operable to receive fluid coolant substantially in the form of a liquid into the heat exchanger, and the outlet operable to dispense fluid coolant at least partially in the form of a vapor out of the heat exchanger;

a first structure which directs a flow of the fluid coolant substantially in the form of a liquid to the heat exchanger, thermal energy communicated from the heat-generating structure to the fluid coolant causing the fluid coolant substantially in the form of a liquid to boil and vaporize in the heat exchanger so that the fluid coolant absorbs at least a portion of the thermal energy from the heat-generating structure as the fluid coolant changes state;

a condenser heat exchanger that receives a flow of the fluid coolant at least partially in the form of a vapor from the heat exchanger and transfers at least a portion of the thermal energy within the fluid coolant to a heat sink; and a second condenser that assists the condenser heat exchanger in transferring at least a portion of the thermal energy within the fluid coolant away from the fluid coolant, the second condenser selectively activated when the heat sink reaches an undesirable temperature.

6. The cooling system of claim 5, wherein the heat sink is a fluid at ambient temperature.

7. The cooling system of claim 6, wherein the fluid is air.

8. The cooling system of claim 5, wherein the second condenser includes a refrigeration cycle that removes thermal energy away from the fluid coolant.

9. The cooling system of claim 5, wherein the secondary condenser includes a thermoelectric cooler (TEC) that removes thermal energy away from the fluid coolant.

10. The cooling system of claim 9, wherein the thermoelectric cooler (TEC) in removing the thermal energy away from the fluid coolant transfers the thermal energy to the heat sink.

11. The cooling system of claim 9, wherein the thermoelectric cooler (TEC) in removing the thermal energy away from the fluid coolant transfers the thermal energy to a fluid loop.

12. The cooling system of claim 11, wherein the fluid loop is a two-phase fluid loop that ultimately transfers at least a portion of the thermal energy to the heat sink.

13. The cooling system of claim 9, wherein the thermoelectric cooler (TEC) is additionally operable to selectively add thermal energy to the fluid coolant.

14. The cooling system of claim 13, wherein the TEC selectively adds thermal energy to the fluid coolant to prevent freezing of the fluid coolant.

15. The cooling system of claim 13, wherein the fluid coolant is a mixture of antifreeze and water and the thermoelectric cooler (TEC) in selectively adding thermal energy to the fluid coolant facilitates a separation of the water from the antifreeze.

16. The cooling system of claim 5, wherein at least the heat exchanger operates at a sub-ambient temperature.

17. A cooling system for a heat-generating structure, the cooling system comprising:

a heat exchanger in physical contact and conductive thermal communication with a heat-generating structure, the heat exchanger having an inlet and an outlet, the inlet operable to receive fluid coolant substantially in the form of a liquid into the heat exchanger, the outlet operable to dispense fluid coolant at least partially in the form of a vapor out of the heat exchanger, and the heat exchanger operating at a sub-ambient temperature;

a first structure which directs a flow of the fluid coolant substantially in the form of a liquid to the heat exchanger, thermal energy communicated from the heat-generating structure to the fluid coolant causing the fluid coolant substantially in the form of a liquid to boil and vaporize in the heat exchanger so that the fluid coolant absorbs at least a portion of the thermal energy from the heat-generating structure as the fluid coolant changes state;

a condenser heat exchanger that receives a flow of the fluid coolant at least partially in the form of a vapor from the heat exchanger and transfers at least a portion of the thermal energy within the fluid coolant to an ambient fluid; and a second condenser that assists the condenser heat exchanger in transferring at least a portion of the thermal energy within the fluid coolant away from the fluid coolant, the second condenser selectively activated when the ambient fluid reaches an undesirable temperature.

18. The cooling system of claim 17, wherein the second condenser includes a refrigeration cycle that removes thermal energy away from the fluid coolant.

19. The cooling system of claim 17, wherein the secondary condenser includes a thermoelectric cooler (TEC) that removes thermal energy away from the fluid coolant.

20. The cooling system of claim 19, wherein the thermoelectric cooler (TEC) in removing the thermal energy away from the fluid coolant transfers the thermal energy to the ambient fluid.

21. The cooling system of claim 19, wherein the thermoelectric cooler (TEC) in removing the thermal energy away from the fluid coolant transfers the thermal energy to a fluid loop.

22. The cooling system of claim 20, wherein the fluid loop is a two-phase fluid loop that ultimately transfers at least a portion of the thermal energy to the ambient fluid.

23. The cooling system of claim 19, wherein the thermoelectric cooler (TEC) is additionally operable to selectively add thermal energy to the fluid coolant.

24. The cooling system of claim 23, wherein the thermoelectric cooler (TEC) selectively add thermal energy to the fluid coolant to prevents freezing of the fluid coolant.

25. The cooling system of claim 23, wherein the fluid coolant is a mixture of antifreeze and water and the thermoelectric cooler (TEC) in selectively adding thermal energy to the fluid coolant facilitates a separation of the water from the antifreeze.

* * * * *